US007285034B2

(12) United States Patent
Kay et al.

(10) Patent No.: US 7,285,034 B2
(45) Date of Patent: Oct. 23, 2007

(54) TOY PLAY SET

(75) Inventors: Robert Kay, Wilmslow (GB); Andrew Needham, Macclesfield (GB); Gary Collins, Redondo Beach, CA (US); Stephen Lau, Torrance, CA (US); Jeffrey Osnato, Hermosa Beach, CA (US); Alan O'Bryan, Lakewood, CA (US)

(73) Assignee: Mattel, Inc., El Segundo, CA (US)

( * ) Notice: Subject to any disclaimer, the term of this patent is extended or adjusted under 35 U.S.C. 154(b) by 132 days.

(21) Appl. No.: 11/027,296

(22) Filed: Dec. 30, 2004

(65) Prior Publication Data

US 2005/0245168 A1 Nov. 3, 2005

Related U.S. Application Data

(60) Provisional application No. 60/614,759, filed on Sep. 30, 2004, provisional application No. 60/533,369, filed on Dec. 30, 2003.

(51) Int. Cl.
*A63H 33/00* (2006.01)

(52) U.S. Cl. ..... 446/73; 446/487

(58) Field of Classification Search ..... 446/71–76, 446/476–478, 487; 206/335
See application file for complete search history.

(56) References Cited

U.S. PATENT DOCUMENTS

| | | | | |
|---|---|---|---|---|
| 296,012 | A | 4/1884 | Jackson | |
| 603,186 | A | 4/1898 | Griffis | |
| 2,544,594 | A | 3/1951 | Goldfarb | |
| 3,578,320 | A | 5/1971 | Goldfarb et al. | |
| 3,761,094 | A | 9/1973 | Belisle | |
| 4,032,141 | A | 6/1977 | Tanimura | |
| 4,103,774 | A | 8/1978 | Shingyouchi | |
| 4,408,763 | A | 10/1983 | Simons | |
| 4,433,504 | A | 2/1984 | Terui | |
| 4,581,904 | A | 4/1986 | Lehmann et al. | |
| 4,696,652 | A * | 9/1987 | Reeder et al. | 446/75 |
| 4,923,429 | A | 5/1990 | Lewis | |
| 4,946,413 | A | 8/1990 | Lehmann et al. | |

(Continued)

FOREIGN PATENT DOCUMENTS

| | | |
|---|---|---|
| GB | 725420 | 3/1955 |

OTHER PUBLICATIONS

K'NEX, *K'Nex* 2004 Catalogue, p. 4 (2004).

*Primary Examiner*—Kien Nguyen
(74) *Attorney, Agent, or Firm*—Akin Gump Strauss Hauer & Feld L.L.P.

(57) ABSTRACT

A toy play set for use in a vehicle having a beverage cup holder includes a generally elongated body. At least a first longitudinal end is sized and shaped to fit at least partially into the cup holder sufficiently for the cup holder to support the body in a generally upright orientation when the body has in a closed configuration. The body has an open configuration in which a hollow interior is at least partially accessible through at least one opening in a side wall. A plurality of movable components is stored in storage positions within the hollow interior in the closed configuration of the body. At least two of the plurality of movable components are removable from the storage position and are repositionable in the open configuration of the body into at least one play position different from the storage position of the at least two movable components.

20 Claims, 11 Drawing Sheets

U.S. PATENT DOCUMENTS 4,964,831 A 10/1990 Wolff
4,966,277 A 10/1990 Razzore
5,029,700 A 7/1991 Chen
5,035,324 A 7/1991 Bertrand
5,074,561 A 12/1991 Johnson
5,167,564 A 12/1992 Lord
5,197,735 A 3/1993 Land et al.
5,209,345 A 5/1993 Haugabook
5,224,894 A 7/1993 Nelson et al.
5,261,848 A 11/1993 Kaplan et al.
5,375,828 A 12/1994 Shikami
5,419,436 A 5/1995 Powell
5,540,611 A 7/1996 Lapoint et al.
5,632,926 A * 5/1997 Dyer, Jr. ..... 249/121
5,803,306 A 9/1998 Lewis
5,851,415 A * 12/1998 Thomas ..... 249/117
5,897,418 A 4/1999 Spector
5,931,099 A * 8/1999 Bruner et al. ..... 104/53
5,980,352 A 11/1999 Rigberg
5,996,781 A 12/1999 Glaser et al.
6,098,794 A 8/2000 Lin
6,117,502 A 9/2000 Liao
6,120,295 A 9/2000 Pracas
6,146,721 A 11/2000 Freynet
6,203,393 B1 3/2001 Flynn
6,210,762 B1 * 4/2001 Pielow ..... 428/7
6,247,729 B1 6/2001 Kaufman
6,367,799 B1 4/2002 Sippel
6,506,094 B1 1/2003 Chang
6,575,807 B2 6/2003 Spector
6,652,024 B2 11/2003 Prasatek
6,695,667 B1 * 2/2004 Kee ..... 446/73
6,719,606 B1 4/2004 Mukensturm
6,752,679 B1 6/2004 Lui
2002/0039609 A1 4/2002 Bezek et al.
2002/0182974 A1 12/2002 Grabianski
2004/0203317 A1 10/2004 Small
2005/0012274 A1 1/2005 Ritter et al.
2005/0017452 A1 1/2005 Stein

* cited by examiner

TOY PLAY SET

CROSS-REFERENCE TO RELATED APPLICATIONS

This application claims the benefit of U.S. Provisional Patent Application No. 60/614,759, entitled "Toy Play Set", filed Sep. 30, 2004, and U.S. Provisional Patent Application No. 60/533,369, entitled "Toy Play Set", filed Dec. 30, 2003.

BACKGROUND OF THE INVENTION

This invention generally relates to toy play sets, and in particular to toy play sets for use with conventional, unpowered, toy objects such as 1/64 scale toy vehicles (e.g., Hot Wheels® and Matchbox® toy vehicles) and/or figurines. It is known to provide play sets for use with reduced scale toy vehicles. Conventional play sets are not well-suited for use by a child while riding in a vehicle such as a car. It is believed that a play set adapted for use by a child riding in a vehicle would be desirable.

BRIEF SUMMARY OF THE INVENTION

Briefly stated, the present invention is a toy play set for use in a vehicle having a beverage cup holder. The toy play set includes a generally elongated body having a hollow interior, a center axis, first and second opposing longitudinal ends, and a generally curved side wall extending around the hollow interior and center axis between the ends. The ends and side wall generally surround the hollow interior in a closed configuration of the body. The body has at least one opening in the side wall and an open configuration in which the hollow interior is at least partially accessible through the one opening in the side wall. A plurality of movable play set components is sufficiently limited in number and size to enable the plurality of components to be stored in storage positions within the play set in a closed configuration of the play set and to be removed from the storage position and from the play set in an open configuration of the play set. At least two of the plurality of movable components are removable from the respective storage positions of each and further are repositionable in the open configuration of the body into at least one play position supported by the body and different from the respective storage position of each of the at least two movable components. The play set has in at least the closed configuration, at least one longitudinal end sized and shaped to fit at least partially into the beverage cup holder sufficiently for the beverage cup holder to support the play set in a generally upright orientation with another opposing end of the play set forming a top end of the play set.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings which are diagrammatic and not necessarily uniformly scaled.

DETAILED DESCRIPTION OF THE INVENTION

Figure 1:
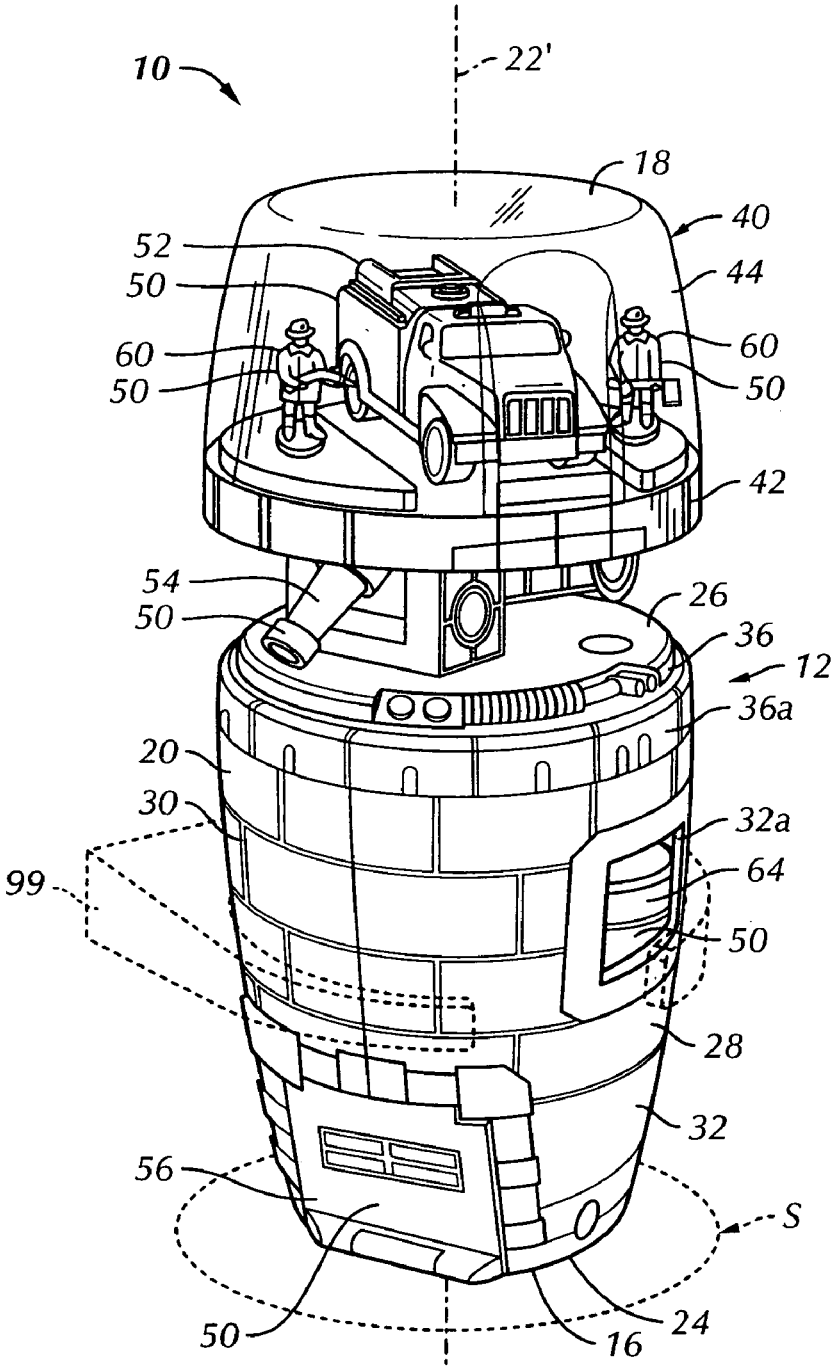
FIG. 1 is a perspective view of a toy play set, shown in a storage configuration, in accordance with a first preferred embodiment of the present invention.

Certain terminology is used in the following description for convenience only and is not limiting. The words "right", "left", "upper" and "lower" designate directions in the drawings to which reference is made. The terminology includes the words above specifically mentioned, derivatives thereof, and words of similar import.

U.S. Provisional Patent Application No. 60/614,759, entitled "Toy Play Set", filed Sep. 30, 2004, and U.S. Provisional Patent Application No. 60/533,369, entitled "Toy Play Set", filed Dec. 30, 2003, are incorporated by reference herein in their entirety.

Figure 2:
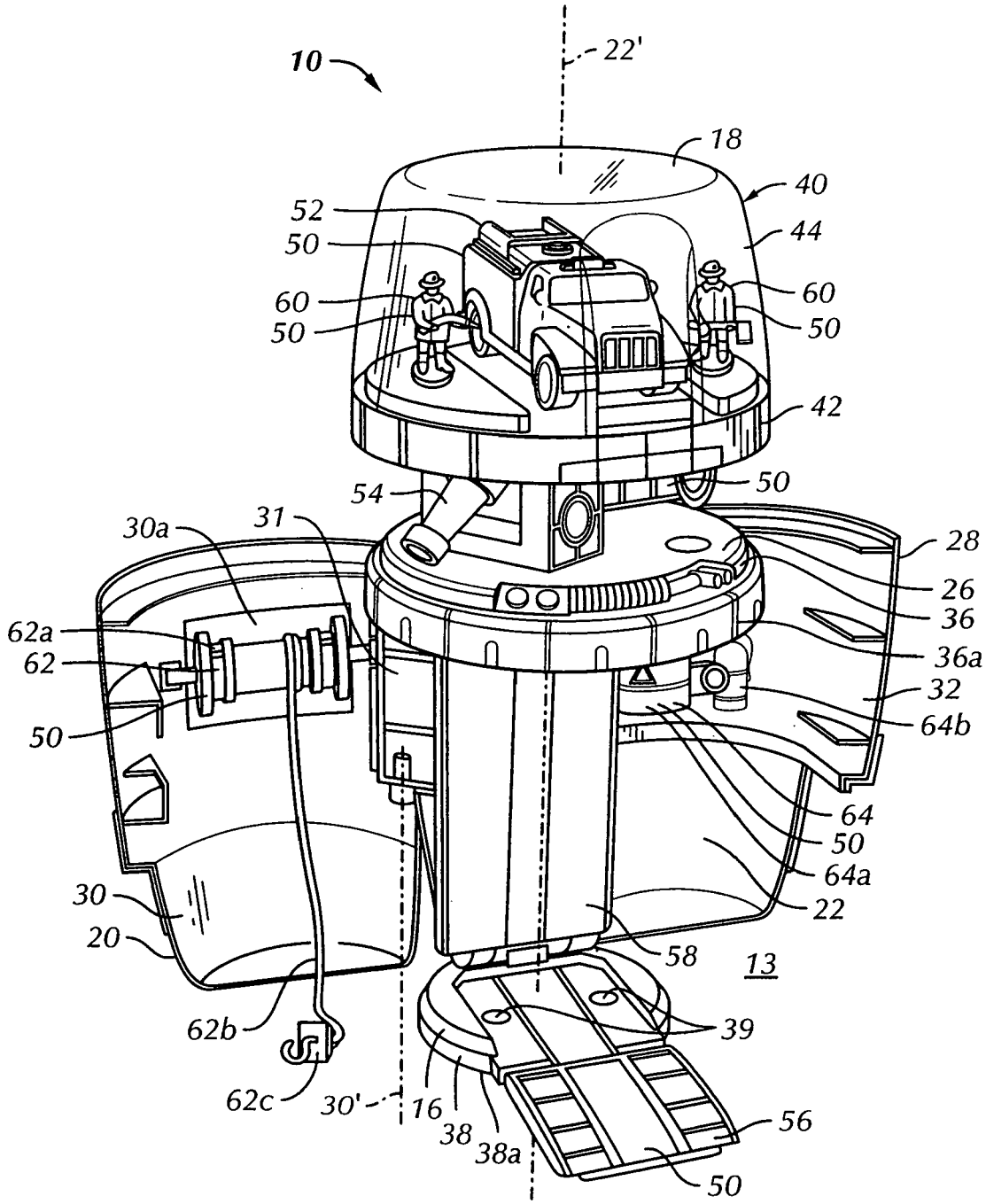
FIG. 2 is a perspective view of the play set of FIG. 1, shown in a partially open configuration.
Figure 3:
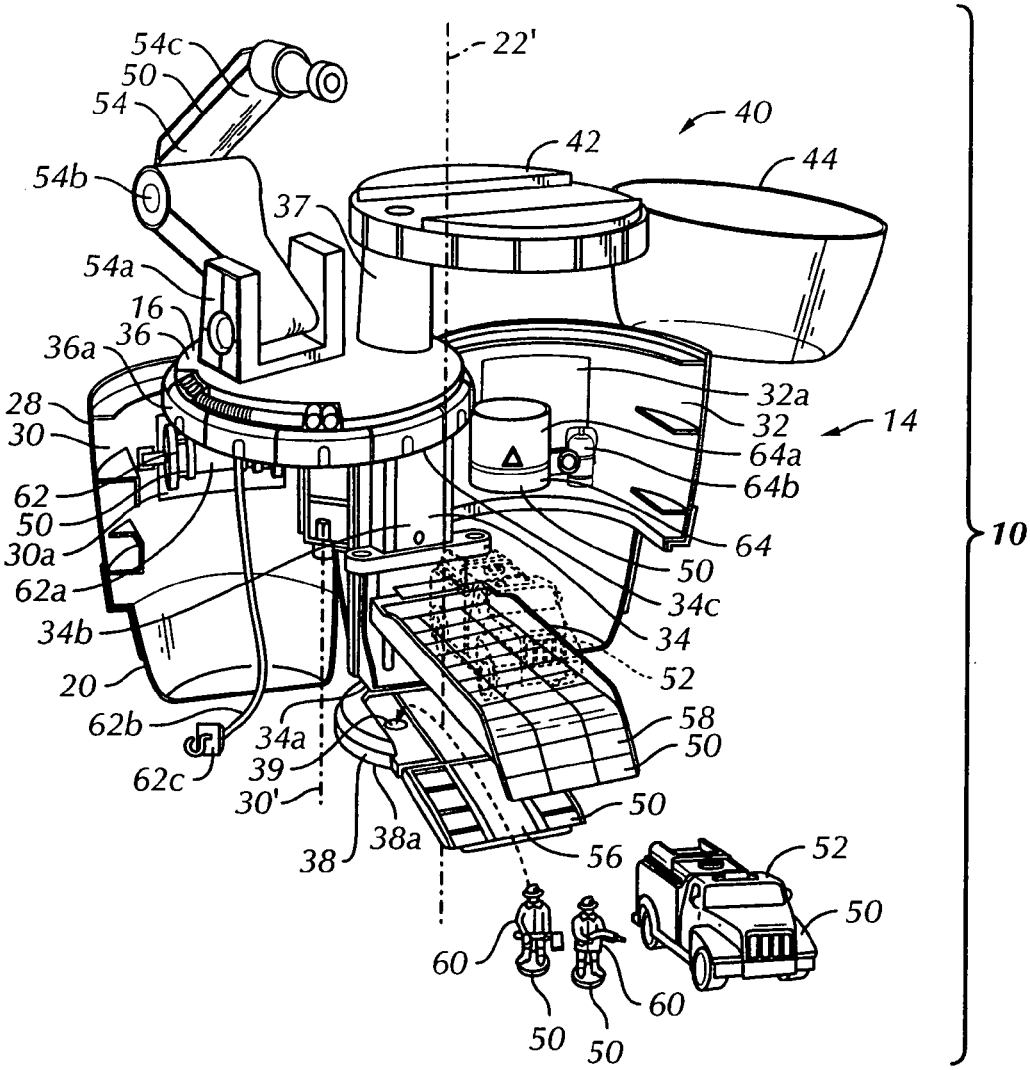
FIG. 3 is a perspective view of the play set of FIGS. 1 and 2, shown in a fully open configuration.

With reference to the accompanying FIGS. 1–3, a first embodiment toy play set is indicated generally at 10. Preferably, the first embodiment play set 10 has a theme related to rescue vehicles and activities, and, more specifically, fire fighting vehicles and activities, as will be described below. The play set 10 has a "closed" or "storage" configuration, indicated generally at 12 in FIG. 1, and an "open" or "play" configuration indicated generally at 14 in FIG. 3. The first embodiment play set 10 includes opposing, longitudinal first and second ends 16, 18, which are a bottom or lower end and a top or upper end of the play set 10 in an upright orientation of the play set 10 depicted in FIGS. 1-3. In the storage configuration 12, the first embodiment play set 10 is of a size and shape to allow the play set 10 to be installed within a conventional beverage cup holder 99 (in phantom in FIG. 1), as are often provided in vehicles (not shown) such as cars and pick-up trucks.

The toy play set 10 includes a generally elongated body, indicated generally at 20, having a hollow interior 22, a center axis 22', first and second opposing longitudinal ends 24, 26, and a generally curved side wall 28 extending around the hollow interior 22 and center axis 20' between the ends 24, 26. Body 20 has a closed, storage configuration, also indicated at 12 in FIG. 1, a partially opened play configuration indicated generally at 13 in FIG. 2 and a fully opened play configuration 14 in FIG. 3. The ends 24, 26 and side wall 28 generally surround the hollow interior 22 and center axis 22 in the closed configuration 12 of the body 20. The body 20 has in the closed configuration 12 at least the first longitudinal end 24 sized and shaped to fit at least partially into the cup holder 99 sufficiently for the cup holder 99 to support the body 20 in a generally upright orientation with the second end 26 forming a top end of the body 20. At least a portion of the side wall 28 tapers radially outwardly to increase a cross-sectional area of the body 20 perpendicular to the central axis 22' as the side wall 28 extends away from proximal the first end 16 toward the second end 18 in order to fit the first end 16 snuggly within the cup holder 99. The body 20 has open configurations 13 and 14 in which the hollow interior 22 is at least partially accessible through at least one opening in the side wall 28.

A plurality of movable play set components 50 is sufficiently limited in number and size to enable the plurality of components to be stored in storage positions within the play set 10 and, preferably within the hollow interior 22 of the body 20 in the closed configuration 12 of the body 20 and play set 10 and to be removed from respective storage positions in the play 10 set and preferably from the body 20 preferably through the at least one opening in the side wall 28. At least two of the plurality of movable components 50 are removable from the respective storage positions of each in the play set and further are repositionable in the open configuration 13, 14 of the body 20 and 14 of the play set 10 into at least one play position supported by the body and different from the respective storage position of each of the at least two movable components 50.

The side wall 28 of the body 20 comprises at least one movable portion in the form of a first door 30 positioned in the at least one opening indicated generally at 29 in FIG. 2 in the side wall 28. The first door 30 makes up only a portion of the side wall 28. Preferably, the first door 30 is pivotably engaged to a remainder of the side wall 28 to pivot about an eccentric axis 30' offset from the center axis 22' to allow the first door 30 to open and close with respect to the remainder of the side wall 28 and the at least one opening. The first door 30 is preferably engaged with the remainder of the side wall 28 via a double hinge 31. The double hinge 31 preferably has two opposed sides with one side being pivotably engaged with the first door 30 and the other side being pivotably engaged with the remainder of the side wall 28. In this way, the double hinge 31 allows the first door 30 to pivot at two locations with respect to the remainder of the side wall 28 in order to open or close the first door 30. Although the double hinge 31 is preferred, it is within the spirit and scope of the present invention that the first door 30 be pivotably attached to the remainder of the side wall 28 in another way, such as by using a single hinge, triple hinge, or living hinge, for instance.

Preferably, the side wall 28 also includes a second movable portion in the form of a second door 32 similar to the first door 30. The second door 32 is also preferably pivotably engaged to the remainder of the side wall 28 via a double hinge (hidden from view in FIGS. 1–3) similar to the double hinge 31 of the first door 30 to allow the second door 32 to open and close with respect to the remainder of the side wall 28. The first and second doors 30, 32 are preferably held together by a conventional releasable connection such as a latch, for instance, when the body 20 is in the closed configuration 12.

It is preferable that the body 20 further includes a side wall support 34 disposed at least proximate the side wall 28 and preferably forming a portion of the side wall 28. Preferably, the first and second doors 30, 32 are pivotably engaged with the side wall support 34 as is best seen in FIG. 3, although it is within the spirit and scope of the present invention that the first and second doors 30, 32 be engaged with each other. The side wall support 34 is preferably an elongate member that is generally vertically oriented and has a first, lower end 34*a*, an inner surface 34*b* that faces generally inwardly toward the center axis 22', and a second, upper end 34*c*, which is oppositely disposed from the first end 34*a* although obscured in FIGS. 2 and 3. An outer surface of side wall support 34, opposite inner surface 34*b* but not depicted in any of the figures, forms part of side wall 28 exposed on the outside of the body 20.

A generally circular first platform 36 is preferably engaged with the side wall support 34, preferably at the second end 34*c*. The first platform 34 has an outer circumferential surface 36*a* forming part of the side wall 28. Although portrayed as circular, the first platform 36 is not intended to be limited to being circular in shape. As such, the first platform 36 can have other shapes, such as polygonal or ovular, for instance. Preferably, the first platform 36 is rotatable with respect to the side wall support 34 from and toward an initial position occupied by the first platform 34 in the closed configuration 12 of the body 20 (see FIG. 1). A center of the first platform 34 is at least generally aligned with the center axis 22' of the body 20 in the initial position of the first platform 34.

Preferably, the play set 10 further comprises a container 40 disposed proximate the second end 26 of the body 20, the container 40 preferably forming the second end 18 of the play set 10. The container 40 includes a second platform 42 and a lid 44 pivotably engaged with the second platform 42. Preferably, the lid 44 is generally cup-shaped and at least partially sufficiently translucent to enable a user to see through the lid 44 in order to view the interior of the container 40 even when the lid 44 is closed. The lid 44 is preferably pivotably engaged with the second platform 42 to enable the lid 44 to open and close, although it is within the spirit and scope of the present invention that the lid 44 be engaged with the second platform 42 in other conventional ways such as screw threads, snap rings or simply compression friction fit to allow the lid 44 to be disengaged and completely removed from the second platform 42 when opening the container 40. The second platform 42 is preferably rotatably engaged to a stalk 37 extending upwardly from the first platform 36. The second platform 42 preferably is rotatable from and toward an initial position occupied by the second platform 42 in the closed configuration 12 of the play set 10 and body 20 (FIG. 1). A center of the second platform 42 is at least generally aligned with the center axis 22' of the body 20 in the initial position of the second platform 42.

The play set 10 is provided with a plurality of movable play set components indicated generally at 50, preferably including one or more miniature toy vehicles like miniature vehicle 52 and one or more figurines 60 for use with the play set 10. As seen in FIGS. 1 and 2, the miniature vehicle 52 and figurines 60 may be stored in positions within the container 40 when the play set 10 including the body 20 is in the closed configuration 12 and the components 50 are in the storage positions. Although this is preferred, it is within the spirit and scope of the present invention that the miniature vehicle 52 and figurines 60 be sufficiently small in size and number to be stored within the hollow interior 22 of the body 20 when in the closed configuration 12. Preferably, the miniature vehicle 52 resembles a fire truck or other such emergency-type vehicle, although it is within the spirit and scope of the present invention that the miniature vehicle 52 take the form of any vehicle. The miniature vehicle 52 is removable from within either the container 40 or the body 20 for use with, in, on and/or around the play set 10 during play. Preferably, each figurine 60 would be configured to represent a related individual like a fire fighter.

In addition to toy components 52, 60 that are "free", meaning unsecured with and removable from a remainder of the play set 10, the plurality of toy components 50 may also include components engaged with the body 20 or other part of the play set structure. The play set 10 preferably comprises a movable toy component 54 rotatably engaged with a top surface of the first platform 36. The movable toy component 54 is preferably a toy articulated arm snorkel which at least generally resembles equipment used in fire fighting. The movable toy component 54 preferably includes a base 54*a* which is at least rotatably engaged with the top surface of the first platform 36. It is further preferable that the base 54*a*, in addition to being rotatable, is also slidable with respect to the first platform 36. A first arm segment 54*b* is pivotably attached to the base 54*a*, and a second arm segment 54*c* is pivotably attached to the first arm segment 54*b*. With this configuration, the movable toy 54 can be manipulated by the user to achieve a plurality of positions when the play set 10 is in the play configuration (see FIG. 3, in which one such position is portrayed) while also being able to be folded into a relatively compact configuration to fit between the first and second platforms 36, 42, within a perimeter defined by side walls of those platforms 36, 42 when the play set 10 is in the closed configuration 12 (see FIG. 1). Although this configuration of the movable toy component 54 is preferred, it is within the spirit and scope of the present invention that the movable toy component 54 take other forms different from the toy articulated arm snorkel described above.

The play set 10 further comprises a base platform 38 at the first end 24 of the body 20. A center of the base platform 38 is at least generally aligned with the center axis 22'. The base platform 38 includes an outer end surface 38*a* at the first end 24 which is sufficiently flat to support the body 20 in the upright orientation on a substantially flat surface indicated in phantom at S in FIG. 1. The base platform 38 preferably is non-rotatably fixed with the first end 34*a* of the side wall support 34 and is spaced from the first platform 36. The base platform 38 and side wall support 34 may be portions of a single molded piece or separate parts non-rotatably secured together. Although the base platform 38 is preferably non-rotatable, it is within the spirit and scope of the present invention that the base platform 38 be rotatable with respect to the side wall support 34. The base platform 38 preferably has a generally circular, disk-like shape and may be cylindrical with constant maximum cross-sectional dimension over most or all of its height or might slightly taper to increase its maximum cross sectional dimension as its side wall extends upward from its bottom wall. While the base platform 38 preferably has a generally circular (cylindrical or conical) cross sectional shape along its height, it may take other shapes including polygonal and irregular or asymmetric shapes. All are intended to be covered as long as they are sized and shaped to be received and held upright in vehicle cup holders. In this way, the shape of the base platform 38 sufficient to enable the first embodiment play set 10 to be used, as will be described, in the cup holder 99 or without the cup holder 99 on a suitably level playing surface like "S". Alternatively or in addition, the containers 40 may be sized and shaped to be received in a conventional vehicle beverage cup holder 99 and support the play set 10 in at least the closed configuration 12 in an upright orientation with first end 16 at the top instead of being in the holder.

The plurality of movable toy components 50 preferably further includes a ramp 56 pivotably engaged with the base platform 38 so as to be extendable outwardly from the base platform 38, generally perpendicular to the center axis 22', when the body 20 is in the open configuration 14 and the component 56 is in play position. The ramp 56 preferably extends generally away from the base platform 38 toward the second end 18, generally parallel to the center axis 22', when the body 20 is in the closed configuration 12 and the component 56 is in the storage position. Preferably, the ramp 56 forms a portion of the side wall 28 when the body 20 is in the closed configuration 12 and the plurality of components 50 is in the storage position. That is, one or each of the first and second doors 30, 32 preferably is shaped to include a cut-out within which the ramp 56 is positioned when the body 20 is in the closed configuration 12. Although this is preferred, it is within the spirit and scope of the present invention that the ramp 56 be completely enclosed by the first and second doors 30, 32 when the body 20 is in the closed configuration 12.

The plurality of components 50 preferably further includes an elevator 58 extending outwardly from the side wall support 34 along the inner side 34*b* of the side wall support 34. The elevator 58 is slidable along the side wall support 34, preferably along a track or equivalent structure. Preferably, the elevator 58 is pivotable with respect to the side wall support 34. In this way, the elevator 58 can be positioned to extend generally perpendicularly from the side wall support 34 when the body 20 is in the open configuration 14 and the component 58 is in a play position and to extend generally parallel to the side wall support 34 when the body 20 is in the closed configuration 12 and the component plurality 58 is in the storage position. The elevator 38 is preferably sized to support the miniature vehicle 52 (shown in phantom on the elevator 58 in FIG. 3) when the body 20 is in the open configuration 14 during play whereby the vehicle 52 is supported by the body 20 in such play position.

The upper surface of base platform 38 further includes a plurality of depressions 39 (see FIG. 2) which are sided and shaped to receive the base of each figurine 60. Depressions 39 can be used as storage or play positions for the figurines whereby the figurines can be positioned in the body 20 in storage or play configurations of play set 10 and body 20. Flat surfaces surrounding depressions 39 can also be used to support figurines 60 as well. Also, the elevator 58 is sufficiently sized to allow the elevator 58 to fit within the hollow interior 22 of the body 20 in the closed configuration 12. Preferably, engagement of the elevator 38 within the track or equivalent structure of the side wall support 34 is sufficiently tight to allow the elevator 58 to frictionally maintain itself in a selected, elevated position when raised above a lowermost position during play. Alternatively, a screw-type mechanism to raise and lower the elevator 38 could be provided.

The plurality of toy components 50 further includes additional movable toys 62, 64 engaged with the body 20, namely a toy winch assembly 62 disposed within an opening 30*a* of the first door 30 and a toy barrel 64 disposed within an opening 32*a* of the second door 32. The movable toys 62, 64 preferably are rotatable with respect to the body 20 and are disposed substantially within the hollow interior 22 of the body 20.

The toy winch assembly 62 includes a winch reel 62*a* rotatably engaged with the first door 30, a rope 62*b* connected at one end to the winch reel 62*a*, and a hook 62*c* attached to another end of the rope 62*b*. Rotation of the winch reel 62*a* causes the rope 62*b* to be let out or taken in depending on the direction of rotation, thereby moving the hook 62*c*. In this way, by rotating the winch reel 62*a* during play, the user can simulate the lifting and movement of objects (not shown) using the toy winch assembly 62.

The toy barrel 64 includes a generally cylindrically-shaped barrel 64*a* fixed to the second door 32 and a lever 64*b* pivotably attached to the barrel 64*a*. Preferably, the lever 64*b* is in the shape of a fire extinguisher and functions to cause actuation of a prop (not shown) within the barrel 64*a*. It is preferable that actuation of the lever 64*b* cause a prop fashioned to resemble flames to extend upwardly from a top of the barrel 64*a* in order to simulate a flaming barrel. In this way, the user can simulate putting out the "fire" during play.

In use, the user may choose to use the first embodiment play set 10 for play activities during travel. With the play set 10 is in the closed, storage configuration 12, the user may store the play set 10 in a conventional automotive cup holder 99. When ready for play activity, the user may proceed to open the lid 44 and remove the miniature vehicle 52 and figurines 60 from the container 40. Further, the user may proceed to release the latch and open the first and second doors 30, 32. Also, the ramp 56 can be rotated to extend outwardly from the base platform 38. If the miniature vehicle 52 and figurines 60 were alternatively stored within the hollow cavity 22 of the body 20 instead of the container 40, the miniature vehicle 52 and figurines 60 can now be removed therefrom. The elevator platform 58 can then be pivoted into an operative position generally parallel to the base platform 38, as illustrated in FIG. 3. The first and second platforms 36, 42 may then be rotated out of alignment with the center axis 22', as illustrated in FIG. 3, to provide the user with clear access to the elevator 58, the ramp 56, the toy winch assembly 62, the toy barrel 64, and the toy articulated arm snorkel 54 for play activity. The play set 10 can also be used with just the container 40 open and/or the toy snorkel 50 deployed while the body 20 is in its closed configuration and being supported in a vehicle beverage cup holder.

Figure 4:
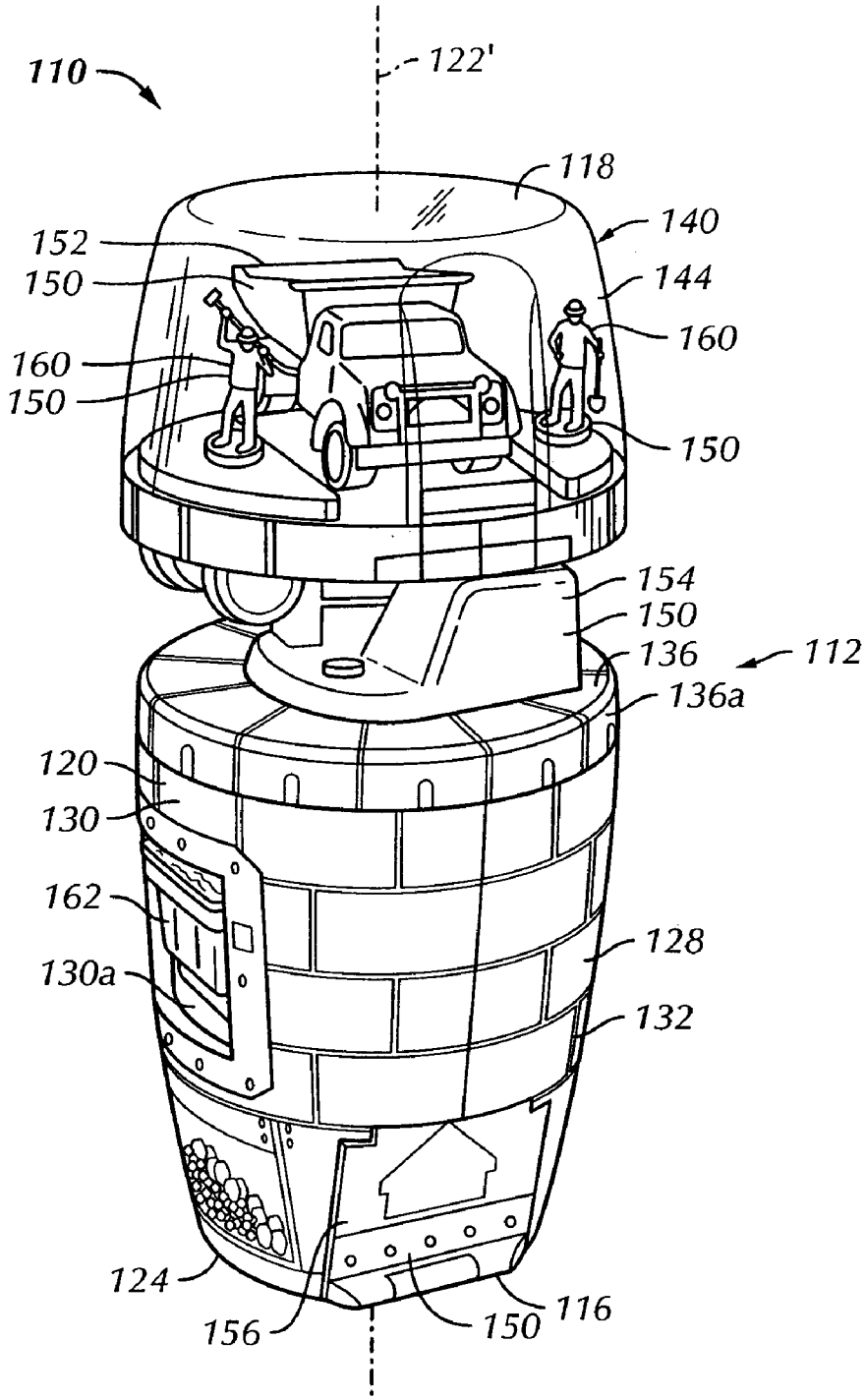
FIG. 4 is a perspective view of a toy play set, shown in a storage configuration, in accordance with a second preferred embodiment of the present invention.
Figure 5:
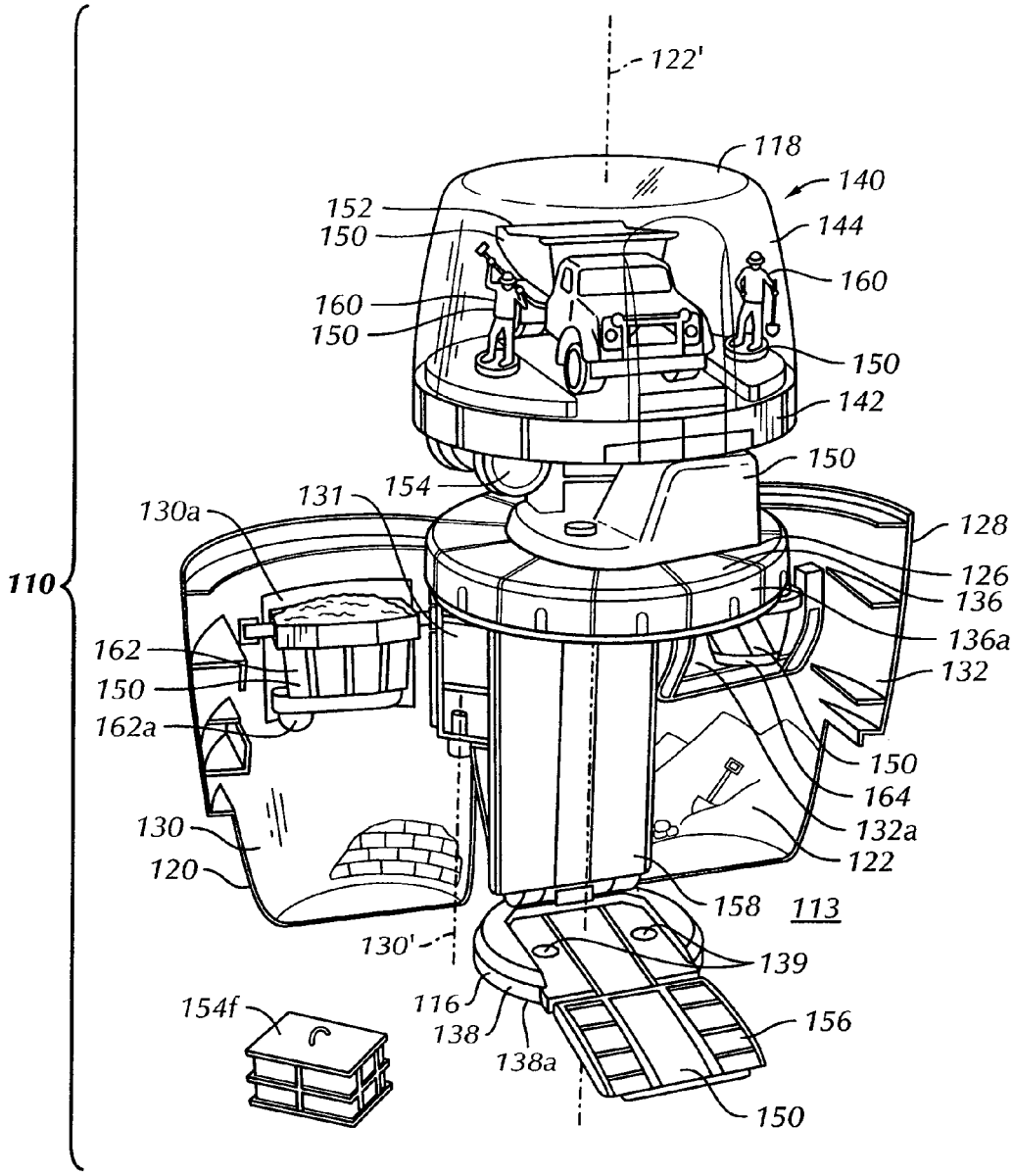
FIG. 5 is a perspective view of the play set of FIG. 4, shown in a partially open configuration.
Figure 6:
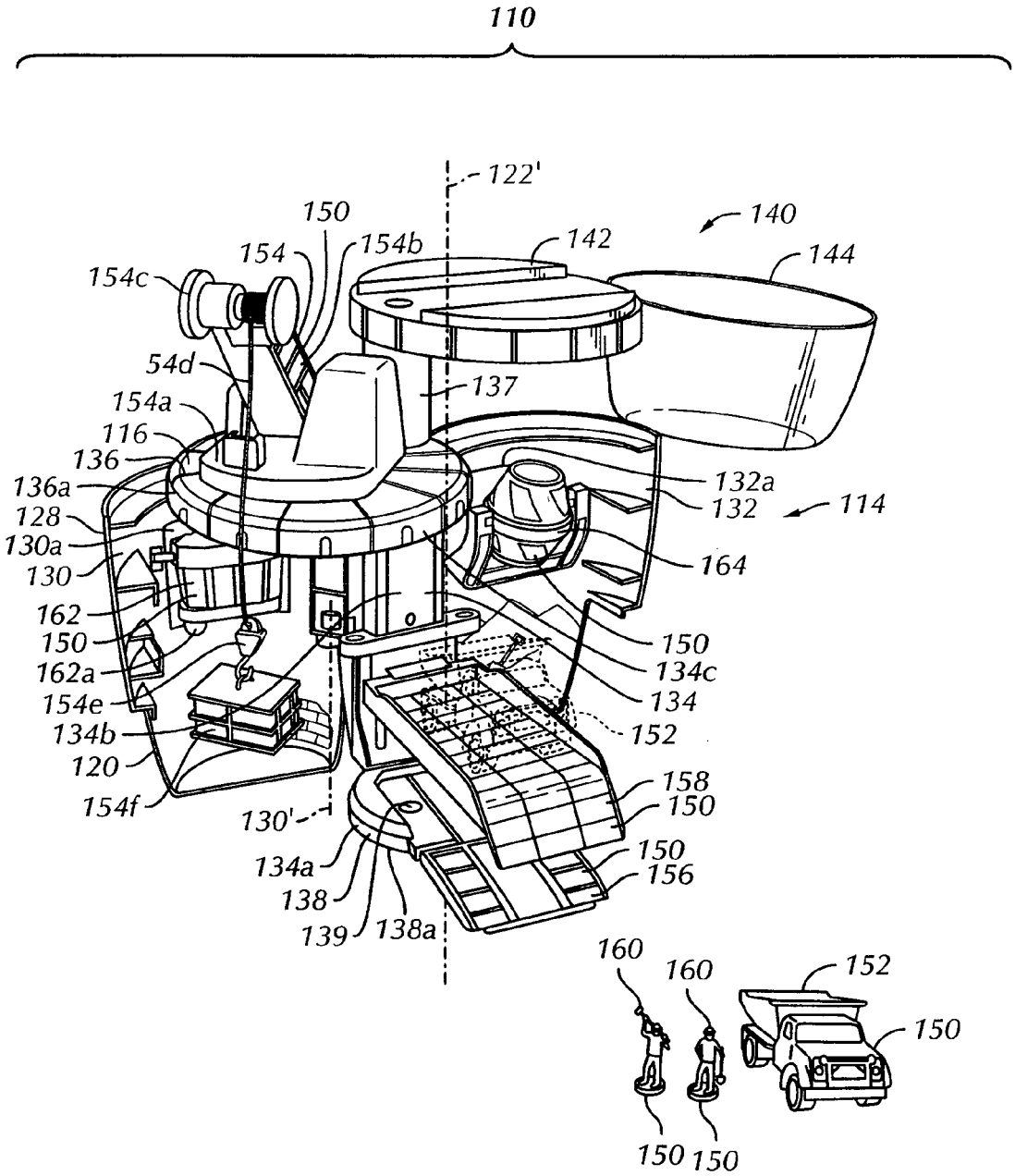
FIG. 6 is a perspective view of the play set of FIGS. 4 and 5, shown in a fully open configuration.

With reference now to FIGS. 4–6, a second embodiment play set 110 is constructed and operated generally similarly to the first embodiment play set 10. In general, elements of the second embodiment play set 110 are assigned reference numbers incremented by 100 above corresponding elements of the first embodiment play set 10. For example, an element of the second embodiment play set 110 corresponding to the base platform 38 of the first embodiment is assigned a reference number of 138. As the structure and operation of the second embodiment play set 110 are generally similar to the structure and operation of the first embodiment play set 10, it is not necessary to describe the additional second embodiment play set 110 in further detail except to point out a few notable differences, as discussed below.

The notable differences between the first embodiment play set 10 and the second embodiment play set 110 are largely due to the play set 110 having a theme related to construction vehicles and activities rather than fire fighting vehicles and activities. That is, rather than having movable toy components resembling fire-fighting-related vehicles figurines and/or other related structures, the play set 110 has construction-related vehicles, figurines and/or other fire fighting related structures.

Specifically, the play set 110 includes a movable toy 154 rotatably engaged with a first platform 136. The movable toy 154 is preferably a toy crane 154 having a base 154*a* rotatably engaged with the first platform 136, an arm 154*b* having one end pivotably attached to the base, a winch reel 154*c* rotatably engaged with another end of the arm 154*b*, a rope 154*d* attached to the winch reel 154*c* at one end, and a hook 154*e* attached to another end of the rope 154*d*. The toy crane 154 is also preferably at least slightly slidable with respect to the first platform 136. This configuration allows the toy crane 154 to be configured by the user in a plurality of play positions when a body 120 of the play set 110 is in an open, play configuration 114 (see FIG. 6). That is, the base 154*a* can be rotated and slid with respect to the first platform 136 and the arm 154*b* can be raised and lowered to position the hook 154*e* in various locations. The hook 154*e* can then be raised or lowered by appropriately rotating the winch reel 154*c*. Optionally, a simulated payload 154*f* can be hooked with the hook 154*e* in order to move the payload 154*f* to simulate construction activities. The configuration of the toy crane 154 further allows the toy crane 154 to be placed in a sufficiently compact configuration to allow the toy crane 154 to fit between the first platform 136 and a second platform 142 within a perimeter defined by the side wall of each platform 136, 142, when the play set 10 including body 120 is in a closed, storage configuration 112 (see FIG. 4). The payload 154*f* is preferably placed within a hollow interior 122 of the body 120 when in the closed configuration 112, although it is possible to store the payload 154*f* within a container 140 at a second, upper end 118 of the play set 110.

Additionally, the play set 110 several free toy components including a miniature toy vehicle 152 which preferably resembles a construction vehicle, such as a dump truck, for instance. The play set 110 further including at least one and preferably at least two free figurines 160, which resemble construction workers.

Lastly, the play set 110 includes movable toys 162, 164 engaged with the body 120, which preferably resemble construction-related machines, including a toy bin 162 and a toy cement mixer 164. The toy bin 162 is pivotably engaged within an opening 130*a* in a first door 130 of the body 120. Preferably, the toy bin 162 is fashioned to resemble a construction container filled with rocks, dirt, and/or other construction-related materials. A handle 162*a* is preferably attached to a bottom of the toy bin 162 to facilitate the pivoting of the toy bin 162 by the user. The toy cement mixer 164 is rotatably engaged within an opening 132*a* in a second door 132 of the body 120. The toy cement mixer 164 is fashioned to resemble a real cement mixing vessel and is rotated manually by the user to simulate the mixing of cement during play.

The first and second embodiment play sets 10, 110 are directed to travel play sets based on themes typically attractive to boys, i.e., themes associated with rescue vehicles and activities or construction vehicles and activities. The inventive concepts associated with the present invention are not limited to such traditionally male-related themes. For example, third and fourth embodiment play sets 210, 310 of the present invention are based on themes believed to be typically attractive to girls.

Figure 7:
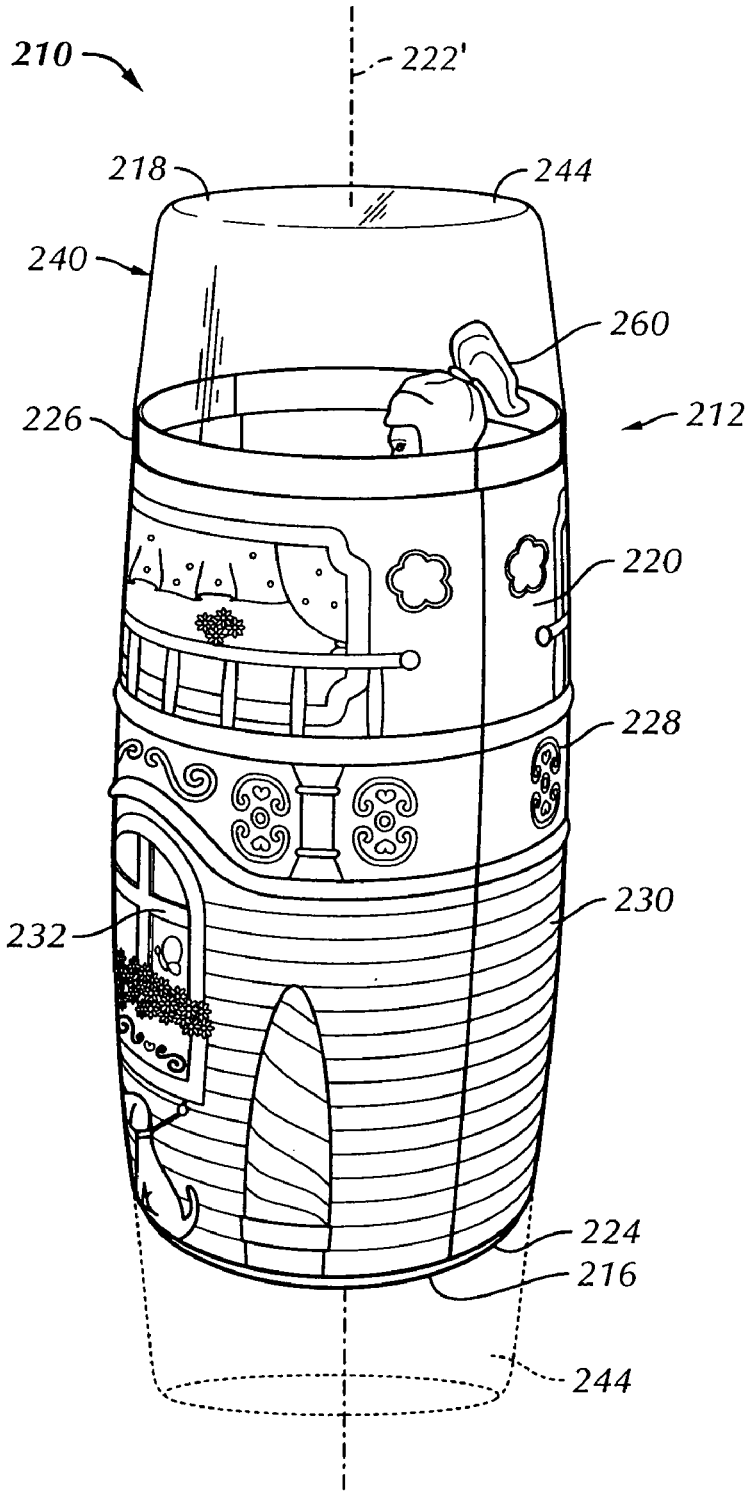
FIG. 7 is a perspective view of a toy play set, shown in a storage configuration, in accordance with a third preferred embodiment of the present invention.
Figure 8:
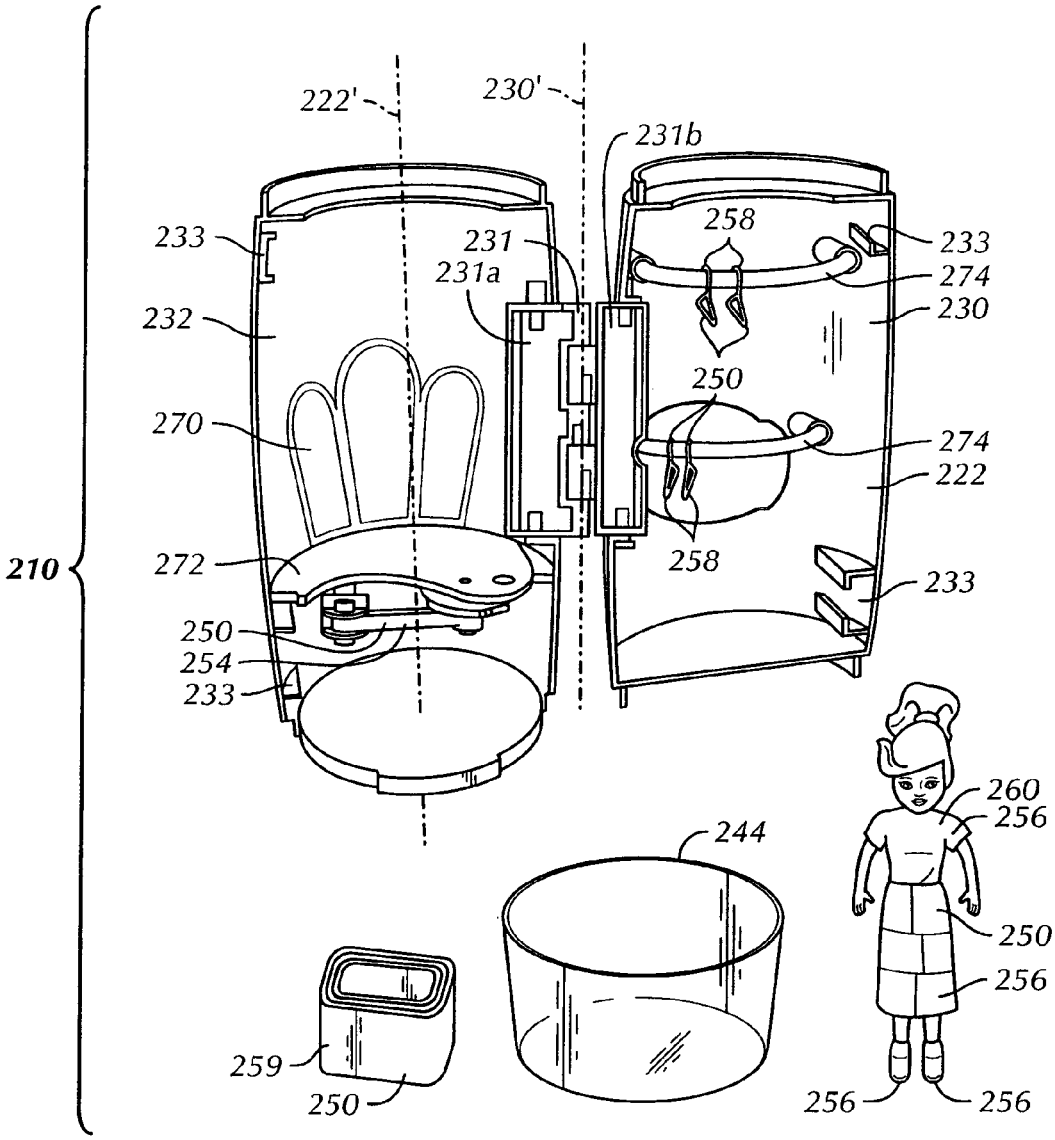
FIG. 8 is a perspective view of the play set of FIG. 7, shown in a partially open configuration.
Figure 9:
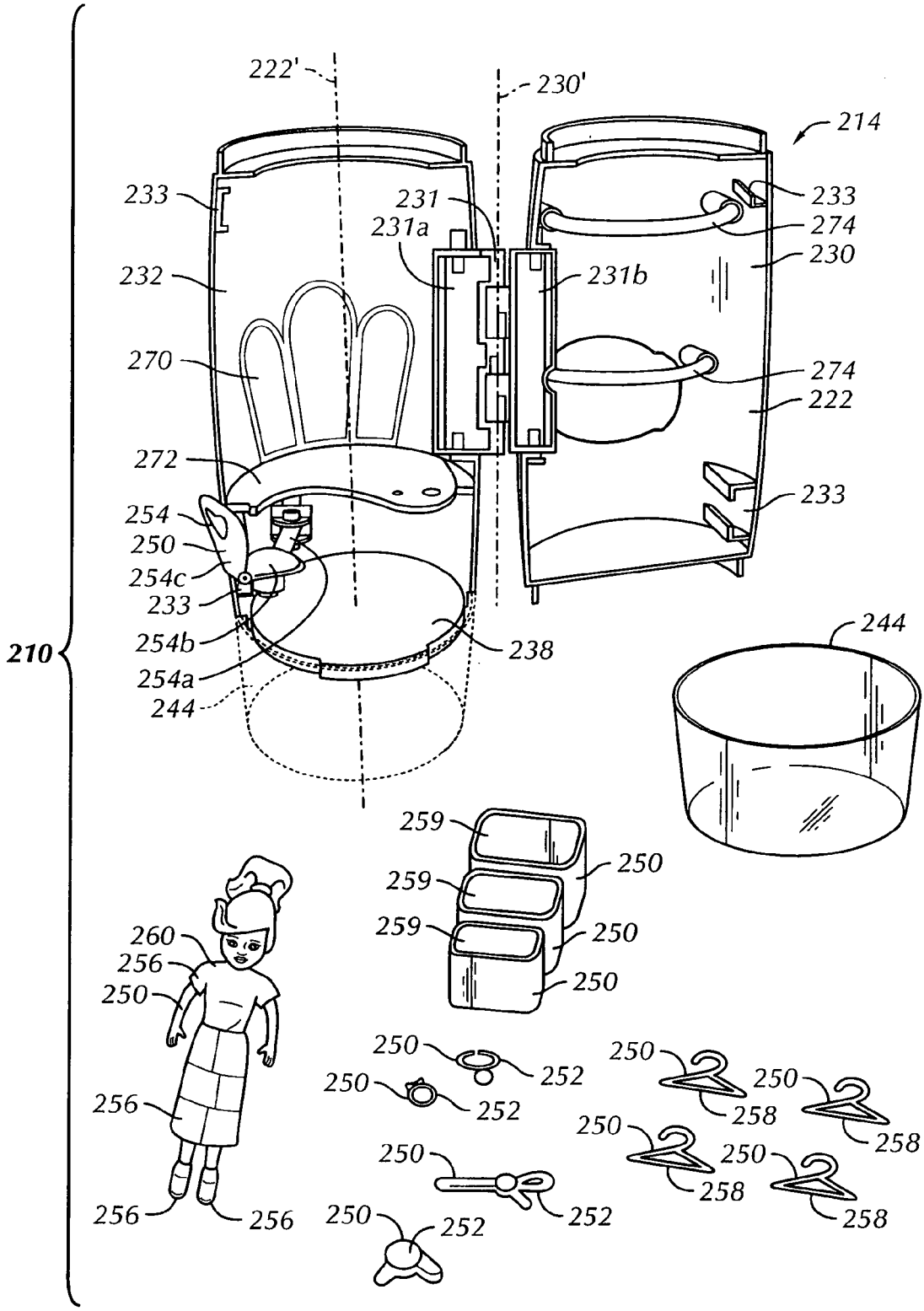
FIG. 9 is a perspective view of the play set of FIGS. 7 and 8, shown in a fully open configuration.

Referring to FIGS. 7–9, the third embodiment play set 210 has a storage configuration 212 (FIG. 7) and a play configuration 214 (FIG. 9). The third embodiment play set 210 has a generally elongated body 220 having a hollow interior 222, a center axis 222', first and second opposing longitudinal ends 224, 226, and a generally curved side wall 228 extending around the hollow interior 222 and center axis 222' between the ends 224, 226, whereby the ends 224, 226 and side wall 228 generally surround the hollow interior 222 in a closed configuration 212 of the body 220 (see FIG. 7).

The body 220 has in the closed configuration 212 at least the first longitudinal end 224 sized and shaped to fit at least partially into the cup holder 99 (see FIG. 1) sufficiently for the cup holder 99 to support the body 220 in a generally upright orientation with the second end 226 forming a top end of the body 220. The body 220 has an open configuration 213 (see FIG. 8) in which the hollow interior 222 is at least partially accessible through at least one opening in the side wall 228.

The body 220 includes a first portion 230 pivotably attached to a remainder 232 of the body to rotate with respect to the remainder 232 along at least one eccentric axis 230' generally parallel to the center axis 222'. Preferably, the first portion 230 makes up essentially a half of the side wall 228, thereby generally splitting the body 220 in half to form clamshell-styled first door 230 and remainder 232. The first door 230 and remainder 232 are preferably retained in the closed configuration 212 by snap fit clasps 233. Preferably, the first door 230 is pivotably engaged with the remainder 232 via a triple hinge 231, which includes two members 231*a*, 231*b* pivotably attached to one another along abutting sides. The first door 230 and remainder 232 are then pivotably attached to respective sides of the members 231*a*, 231*b* opposed from the abutting sides. Although this configuration is preferred, it is within the spirit and scope of the present invention that the first door 230 and remainder 232 be pivotably attached to each other in different ways, such as by using single hinges, double hinges, or living hinges, for instance. Preferably first, lower end 216 includes a base platform 238 joined with a bottom end of the remainder 232 of side wall 228.

The play set 210 has a first, "lower" end 216 and a second, "upper" end 218 and includes a lid 244 removably attachable to at least one of the first and second ends 224, 226 of the body 220. Preferably, the lid 244 is generally cup-shaped and can be engaged with the second end 226 of the body 220 to form a storage space 240 at the second end 218 of the play set 210.

At least the first end 216 of the play set 210 is sized and shaped to releasably and snuggly fit within a conventional automotive-type cup holder 99 (see FIG. 1) when the play set 210 is in the closed configuration 212. This is preferably accomplished by having at least a portion of the side wall 228 taper radially outwardly to increase a cross-sectional area of the body 220 perpendicular to the central axis 222' as the side wall 228 extends away from the first end 224 toward the second end 226 in order to fit the first end 224 snuggly within the cup holder 99.

Alternatively, the second end 218 of the play set 210 can be is sized and shaped to releasably and snuggly fit within a conventional automotive-type cup holder 99 (see FIG. 1) when the play set 210 is in the closed configuration 212. That is, the play set 210 can be turned upside-down so that at least a portion of the lid 244 fits within the cup holder 99. Further alternatively, the lid 244 can be removed from the second end 226 of the body 220 and engaged with the first end 224 of the body 220 (as shown in phantom in FIG. 7). In this way, at least a portion of the lid 244 fits within the cup holder 99 to retain the play set 210 therein, but the play set 210 can be maintained in an upright orientation and need not be inverted.

Similarly, the lid 244 may be engaged with the base platform 238 and the remainder 232 of the side wall 228 when the play set 210 is in the open configuration 214 (as shown in phantom in FIG. 9). In this way, the play set 210 can be retained by the cup holder 99 by at least partially fitting the lid 244 within the cup holder 99 while the play set 210 is in the open configuration 214 to inhibit the play set 210 from unwanted movement within the vehicle during play.

It is preferred that the hollow interior 222 of the body 220 resemble a miniature luxury closet area or dressing room or other such theme that is attractive to girls. To that end, it is preferable that a mirror 270 and vanity 272 are attached within the body 220 to an interior surface of the remainder 232 of side wall 228 and curved rods 274 are mounted to an interior surface of the first door 230.

The play set 210 includes a plurality of movable play set components 250 sufficiently limited in number and size to enable the plurality of components 250 to be stored in storage positions within the hollow interior 222 in the closed configuration 212 of the body 220 and to be removed from the storage position and from the body 220 through the at least one opening in the side wall 228 provided by the first door 230. At least two of the plurality of movable components 250 are removable from the storage position and are repositionable in the open configuration 214 of the body 220 each into at least one play position different from the storage position the movable component 250.

The plurality of movable components 250 includes at least one figurine 260 for use with the play set 210. The at least one figurine 260 is stored within the body 220 when the play set 210 and body 220 are in the closed configuration 212 and the components 250 of the plurality are, in the storage positions. In particular, the figurine 260 is stood on the vanity 272 and held in position by rods 274. The plurality of movable components 250 further includes plastic play pieces 252, resembling necklaces, hair dryers, hair bows, curling irons, and the like. The plastic play pieces 252 are able to be placed on the vanity 272, on the figurine 260, and about the play area to enhance the play scenarios.

Referring specifically to FIG. 9, the plurality of components 250 further includes a movable toy 254 in the form of a toy doll chair 254 at which the figurine 260 can be made to sit for play scenarios. The doll chair 254 is movably engaged with the remainder 232 of side wall 228, is rotatable with respect to the body 220 and is disposed within the hollow interior 222 of the body 220. The doll chair 254 preferably includes an arm 254*a* pivotably mounted at one end below the vanity 272 to the interior surface of the first door 230. A chair bottom 254*b* is preferably rotatably mounted to another end of the arm 254*a*. A chair back 254*c* is pivotably mounted to the chair bottom 254*b* to pivot from a first position generally abutting the chair bottom 254*b* to a second position generally perpendicular to the chair bottom 254*b*. The doll chair 254 is able to be moved from a storage position in which the chair back 254*c* is in the first position and the doll chair is rotated under the vanity 272 to a plurality of play positions in which the chair back 254*c* is placed in the second position and the arm 254*a* is placed in various orientations to allow the figurine 260 to be seated on the doll chair 254 at various play positions with respect to the vanity 272. The figurine 260 could also be positioned on the planar upper surface of the base platform 238 in the open, play configurations of the play set 210 and body 220.

The plurality of components 250 further includes simulated clothing 256, such as shirts, skirts, shorts, dresses, and the like, and miniature hangers 258. It is intended that at least some of the simulated clothing 256 be removable from the figurine 260 and able to be placed on the hangers 258 and hung on the rods 274. The simulated clothing 256 further includes shoes and the like, although the shoes are not intended to be hung on the rods 274. Instead, it is intended that some simulated clothing 256, such as the shoes, can be placed on free standing structural units 259 that can be placed within the body 220 and/or around the play area. The free standing structural units 259 are preferably rectangular boxes having less than six sides so that at least one side is open. It is further preferable that the shelving units 259 appropriately sized to allow the units 259 to be nested one inside the other (see FIG. 8) for compact storage.

In use, all of the above-described components of the play set 210 can be stored within the body 220 when in the closed configuration 212. To place the body 220 in the open configuration 214, the lid 244 is removed from the second end 226 of the body 220, the clasps 233 are unlatched, the first door 230 pivoted away from the remainder 232 of the side wall 228, such that the hollow interior 222 of the body 220 is exposed. The doll chair 254 can be rotated out from under the vanity 272 and the chair back 254*c* placed in the second position (see FIG. 9). It is intended that the lid 244 can be placed upside down to simulate a bath tub for the figurine 260. When in the open configuration 214, at least some of the plurality of components 250 (such as the figurine 260, the plastic play pieces 252, the simulated clothing 256, the hangers 258, and the shelving units 259) can be removed from the body 220 to use in play scenarios simulating activities of the figurine 260, including bathing, putting on make-up, dressing, and the like. The lid 244 can also be used to hold the miscellaneous loose toy components 250 until they are used with the figurine 260 and/or body 220.

Figure 10:
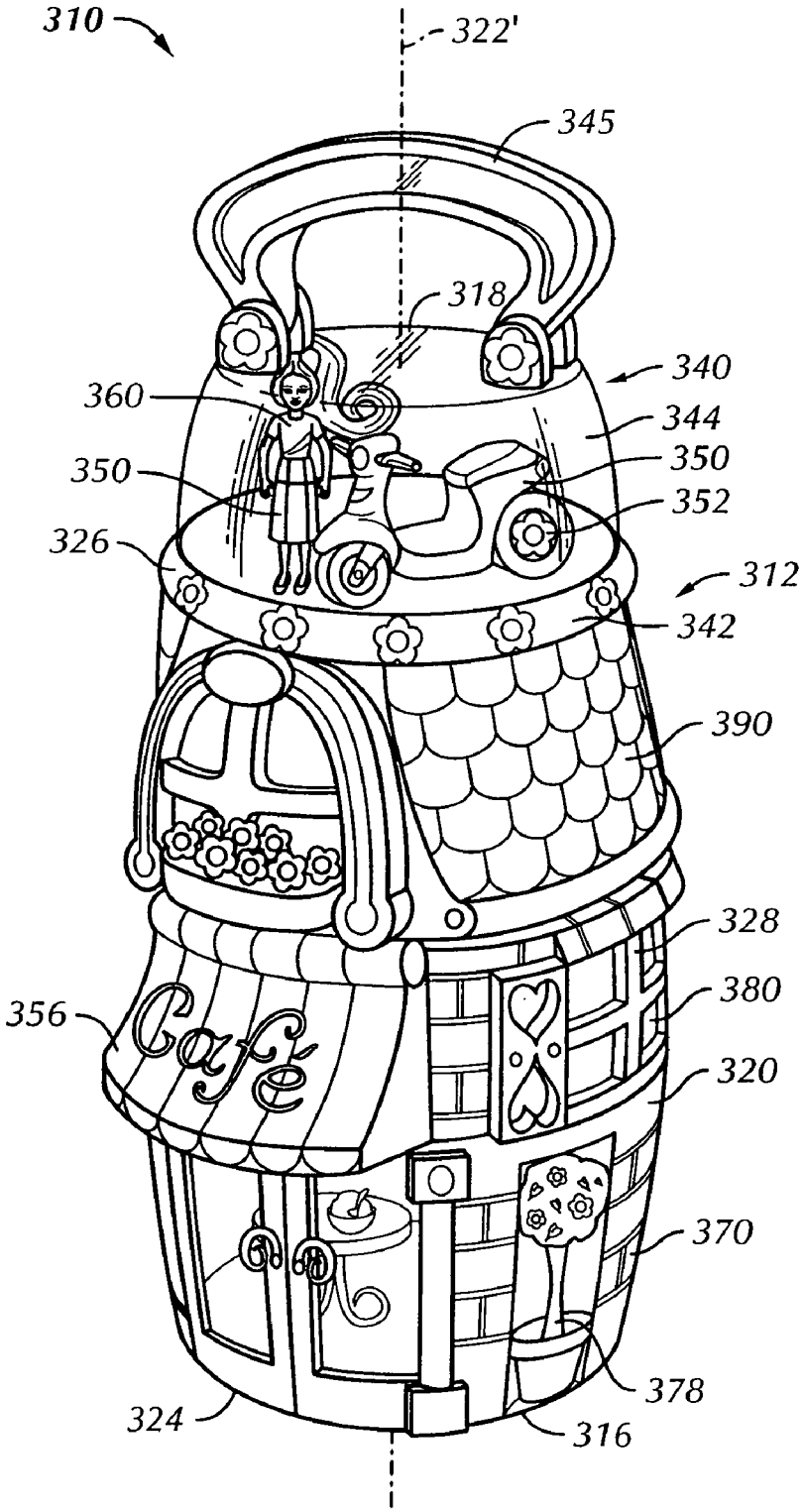
FIG. 10 is a perspective view of a toy play set, shown in a storage configuration, in accordance with a fourth preferred embodiment of the present invention.
Figure 11:
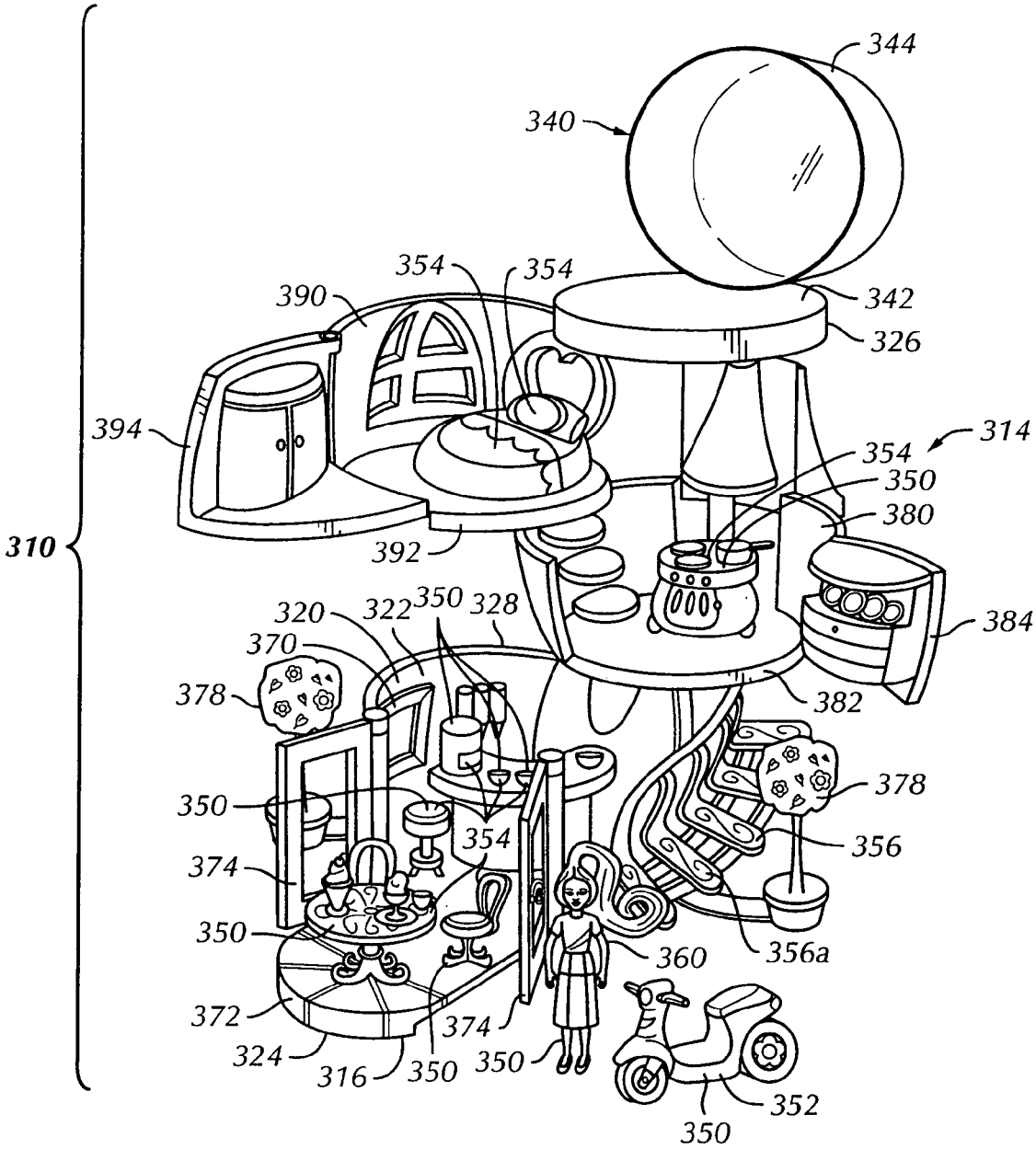
FIG. 11 is a perspective view of the play set of FIG. 10, shown in an open configuration.

With reference to FIGS. 10 and 11, the fourth embodiment play set 310 has a closed, storage configuration 312 (FIG. 10) and an open, play configuration 314 (FIG. 11). The play set 310 has a first, lower end 316 and a second, upper end 318. At least the first end 316 is adapted to releasably and snuggly fit within a conventional automotive-type beverage holder 99 (see FIG. 1) when the play set 310 is in the closed configuration 312.

The play set 310 includes a generally elongated body 320 having a hollow interior 322, a center axis 322', first and second opposing longitudinal ends 324, 326, and a generally curved side wall 328 extending around the hollow interior 322 and center axis 322' between the ends 324, 326, whereby the ends 324, 326 and side wall 328 generally surround the hollow interior 322 in the closed configuration 312 of the body 320. The body 320 has in the closed configuration 312 at least the first longitudinal end 324 sized and shaped to fit at least partially into the cup holder 99 sufficiently for the cup holder 99 to support the body 320 in a generally upright orientation with the second end 326 forming a top end of the body 320. In the open configuration 314, the hollow interior 322 of the body 320 is at least partially accessible through at least one opening in the side wall 328.

The play set 310 comprises a first section 370 proximate the first end 316, second and third sections 380, 390, and a container 340 proximate the second end 318. The first section 370 includes a base member 372, doors 374 pivotally mounted to a remainder of the first section 370. The first section 370 may optionally be provided with side stabilizers 378, which are mounted for movement relative to the first section 370. The stabilizers 378 preferably translate radially between a first stored position (see FIG. 10) and a second extended play position (see FIG. 11).

The second section 380 and third section 390 both preferably include platforms 382, 392, respectively, and doors 384, 394, respectively. The second and third sections 380, 390 have initial positions in which centers of the second and third sections 380, 390 are generally aligned with the center axis 322' of the body 320 when in the closed configuration 312. The second and third sections 380, 390 are preferably rotatable away from the initial position when placing the body 320 in the open configuration 314.

The container 340 has a base platform 342, a lid 344 pivotally mounted to the base platform 342 for movement between a closed position (see FIG. 10) and an open position (see FIG. 11), and an optional handle 345 attached to the lid 344 (shown in FIG. 10 only). The container 340 is preferably rotatable with respect to the remainder of the play set 310 in a manner similar to that described above for the second and third sections 380, 390.

The play set 310 includes a plurality of movable play set components 350 sufficiently limited in number and size to enable the plurality of components 350 to be stored in storage positions within the hollow interior 322 in the closed configuration 312 of the body 320 and to be removed from the storage position and from the body 320 through the at least one opening in the side wall 328. At least two of the plurality of movable components 350 are removable from their respective storage positions and are further repositionable in the open configuration 314 of the body 320 into at least one play position different from the storage position of each of the at least two movable components 350. Specifically, the play set 310 includes decorative elements 354, which can include, for example, miniature tables, chairs, pots, pans, plates, glasses, stools, beds, pillows, or anything else associated with a café and domicile which could enhance the play experience. Additionally, the plurality of components 350 includes a miniature vehicle 352 and a figurine 360, which are preferably stored within the container 340. It is preferable that the miniature vehicle 352 resemble a motor scooter, although it is within the spirit and scope of the present invention that the miniature vehicle 352 resemble some other vehicle that the figurine 360 can "ride" and/or "drive" during play.

The plurality of components 350 further includes a movable toy component 356 which is transformable from an awning configuration when the body 320 is in the closed configuration 312 to a staircase configuration when the body 320 is in the open configuration 314. When in the closed configuration 312, the movable toy component 356 resembles an awning (see FIG. 10) to enhance a café appearance of the play set 310. By rotating and separating individual members 356*a* of the movable toy component 356, a stair-like formation is created in order to simulate a staircase (see FIG. 11) leading from the first section 370 to the second section 380.

Electronic and electromechanical components, though not illustrated, could be added to the various embodiments of the present invention. For example lights, components allowing audibilization of pre-recorded sounds, or conventional audio equipment (including analog and digital radios and devices for the playback of digitally recorded sound (such as compact disk players and MP3 players)) could be incorporated into the various embodiments of the present invention. As a particular example, a play set directed to boys could be provided having a play configuration wherein doors open to reveal a representation of an automobile's dashboard, the dashboard including an operative radio. Or, as a second example, a play set directed to girls could be provided having a play configuration wherein doors open to reveal a dressing table, having an operative radio.

The structural elements of the first through fourth embodiment play sets 10 through 310, respectively, are preferably fabricated from conventional polymeric materials, such as molded polymer plastics.

From the foregoing it can be seen that the present invention comprises a play set 10, 110, 210, 310 having a compact closed or storage configuration 12, 112, 212, 312 such that the play set 10, 110, 210, 310 may be readily stored in a conventional vehicle beverage cup holder 99 making the play set 10, 110, 210, 310 especially well-suited for a child being transported in an automobile.

The bodies 20, 120, 220, 320 of the play sets 10, 110, 210, 310 (or the lid 244 of the alternate configurations of the third embodiment play set 210 discussed above) have diameters that vary at various points along the center axes 22', 122', 222', 322', but are appropriately sized to fit within conventional automobile-type beverage holders 99 (see FIG. 1). It is preferred that the diameters generally uniformly taper from first, smaller diameters (preferably proximate at least one of the first and second ends 16, 18, 116, 118, 216, 218, 316, 318) to second, larger diameters (preferably located at a point between the first and second ends 16, 18, 116, 118, 216, 218, 316, 318) to insure that the play sets 10, 110, 210, 310 can fit snuggly within the beverage holder 99. Although it is preferred that the bodies 20, 120, 220, 320 (or, alternatively, the lid 244) are tapered, it is within the spirit and scope of the present invention that the bodies 20, 120, 220, 320 (or, alternatively, the lid 244) be shaped with a step-like change in diameter. That is, it is intended that the diameter of the bodies 20, 120, 220, 320 (or, alternatively, the lid 244) can change from a relatively small diameter to a relatively large diameter over a relatively short distance along the center axes 22', 122', 222', 322', such that one of the first and second ends 16, 18, 116, 118, 216, 218, 316, 318 of the play sets 10, 110, 210, 310 is stepped. The first, smaller diameters of the bodies 20, 120, 220, 320 (or, alternatively, the lid 244) are suggestedly between about fifty millimeters (about two inches) and about ninety millimeters (about three and one-half inches), and preferably about seventy millimeters (about two and three-quarter inches). The second, larger diameter is suggestedly more than about eighty millimeters and preferably about ninety millimeters (about three and three-quarter inches).

It will be appreciated by those skilled in the art that changes could be made to the embodiments described above without departing from the broad inventive concept thereof. It is understood, therefore, that this invention is not limited to the particular embodiments disclosed.

We claim:

1. A toy play set for use in a vehicle having a beverage cup holder, the toy play set comprising:

a generally elongated body having a hollow interior, a center axis, first and second opposing longitudinal ends and a generally curved side wall extending around the hollow interior and center axis between the ends whereby the ends and side wall generally surround the hollow interior in a closed configuration of the body, the body having at least one opening in the side wall and an open configuration in which the hollow interior is at least partially accessible through the at least one opening in the side wall, wherein the side wall comprises a door positioned in the at least one opening in the side wall, the door making up only a portion of the side wall, the door being pivotably engaged to a remainder of the side wall to pivot about an eccentric axis offset from the center axis, so as to allow the door to open and close with respect to the remainder of the side wall and the at least one opening, and wherein the body further includes a side wall support and a first platform engaged with the side wall support, the first platform having an outer surface forming part of the side wall, the first platform being rotatable with respect to the side wall support from and toward an initial position occupied by the first platform in the closed configuration of the body, a center of the first platform being at least generally aligned with the center axis of the body in the initial position of the first platform; and a plurality of movable play set components sufficiently limited in number and size to enable the plurality of components to be stored in storage positions within the play set interior in a closed configuration of the play set and to be removed from the storage position and from the play set in an open configuration of the play set, at least two of the plurality of movable components being removable from the respective storage positions of each and further being repositionable in the open configuration of the body into at least one play position supported by the body and different from the respective storage position of each of the at least two movable components;

the play set having in at least a closed configuration, at least one longitudinal end sized and shaped to fit at least partially into the beverage cup holder sufficiently for the beverage cup holder to support the play set in a generally upright orientation with another opposing end of the play set forming a top end of the play set.

2. The toy play set of claim 1, further comprising a container disposed proximate the second end of the body, the container having a second platform and a lid movables with respect to the second platform, the second platform being rotatable from and toward an initial position occupied by the second platform in the closed configuration of the body, a center of the second platform being at least generally aligned with the center axis of the body in the initial position of the second platform.

3. The toy play set of claim 2, further comprising a miniature vehicle for use with the play set, the miniature vehicle being stored within the container when the body is in the closed configuration and the plurality of components are in respective storage positions.

4. The toy play set of claim 2, further comprising a base platform at the first end of the body, a center of the base platform being at least generally aligned with the center axis, the base platform being sufficiently flat to support the body in the upright orientation on a substantially flat surface when the body is in the open configuration.

5. The toy play set of claim 4, wherein the base platform is fixed with an end of the side wall support.

6. The toy play set of claim 5, wherein the plurality of components further includes a ramp pivotably engaged with the base platform so as to be extendable outwardly from the base platform, generally perpendicular to the center axis, when the body is in the open configuration and the plurality of components is in the at least one play position, and to extend generally away from the base platform toward the second end, generally parallel to the center axis, when the body is in the closed configuration and the plurality of components is in the storage position.

7. The toy play set of claim 6, wherein the ramp forms a portion of the side wall when the body is in the closed configuration and the plurality of components is in the storage position.

8. The toy play set of claim 1, further comprising a base platform at the first end of the body, a center of the base platform being at least generally aligned with the center axis, the base platform including an outer end surface at the first end sufficiently flat to support the body in the upright orientation on a substantially flat surface.

9. The toy play set of claim 1, wherein the plurality of components further includes an elevator extending outwardly from the side wall support along an inner side of the side wall support, the elevator being slidable along and pivotable with respect to the side wall support so as to extend generally perpendicularly from the side wall support when the body is in the open configuration and the plurality of components is in the at least one play position and to extend generally parallel to the side wall support when the body is in the closed configuration and the plurality of components is in the storage position.

10. The toy play set of claim 1, wherein a first portion of the body is pivotably attached to a second portion of the body to rotate with respect to the second portion along at least one eccentric axis generally parallel to the center axis.

11. The toy play set of claim 10, further comprising a lid that is removably attachable to at least one of the first and second ends of the body.

12. A toy play set for use in a vehicle having a beverage cup holder, the toy play set comprising:

a generally elongated body having a hollow interior, a center axis, first and second opposing longitudinal ends and a generally curved side wall extending around the hollow interior and center axis between the ends whereby the ends and side wall generally surround the hollow interior in a closed configuration of the body, the body having at least one opening in the side wall and an open configuration in which the hollow interior is at least partially accessible through the at least one opening in the side wall;

a plurality of movable play set components sufficiently limited in number and size to enable the plurality of components to be stored in storage positions within the play set interior in a closed configuration of the play set and to be removed from the storage position and from the play set in an open configuration of the play set, at least two of the plurality of movable components being removable from the respective storage positions of each and further being repositionable in the open configuration of the body into at least one play position supported by the body and different from the respective storage position of each of the at least two movable components; and a movable toy rotatably engaged with a first platform, the first platform having an outer surface forming part of the side wall, the first platform being rotatable from and toward an initial position occupied by the first platform in the closed configuration of the body, a center of the first platform being aligned with the center axis of the body in the initial position of the first platform;

the play set having in at least a closed configuration, at least one longitudinal end sized and shaped to fit at least partially into the beverage cup holder sufficiently for the beverage cup holder to support the play set in a generally upright orientation with another opposing end of the play set forming a top end of the play set.

13. The toy play set of claim 12, wherein the movable toy is a toy articulated arm snorkel.

14. The toy play set of claim 12, wherein the movable toy is a toy crane.

15. A toy play set for use in a vehicle having a beverage cup holder, the toy play set comprising:

a generally elongated body having a hollow interior, a center axis, first and second opposing longitudinal ends and a generally curved side wall extending around the hollow interior and center axis between the ends whereby the ends and side wall generally surround the hollow interior in a closed configuration of the body, the body having at least one opening in the side wall and an open configuration in which the hollow interior is at least partially accessible through the at least one opening in the side wall, wherein at least a portion of the side wall tapers radially outwardly to increase a cross sectional area of the body perpendicular to the central axis as the side wall extends away from proximal the first end toward the second end in order to fit the first end snuggly within the cup holder; and a plurality of movable play set components sufficiently limited in number and size to enable the plurality of components to be stored in storage positions within the play set interior in a closed configuration of the play set and to be removed from the storage position and from the play set in an open configuration of the play set, at least two of the plurality of movable components being removable from the respective storage positions of each and further being repositionable in the open configuration of the body into at least one play position supported by the body and different from the respective storage position of each of the at least two movable components;

the play set having in at least a closed configuration, at least one longitudinal end sized and shaped to fit at least partially into the beverage cup holder sufficiently for the beverage cup holder to support the play set in a generally upright orientation with another opposing end of the play set forming a top end of the play set.

16. A toy play set for use in a vehicle having a beverage cup holder, the toy play set comprising:

a generally elongated body having a hollow interior, a center axis, first and second opposing longitudinal ends and a generally curved side wall extending around the hollow interior and center axis between the ends whereby the ends and side wall generally surround the hollow interior in a closed configuration of the body, the body having at least one opening in the side wall and an open configuration in which the hollow interior is at least partially accessible through the at least one opening in the side wall;

a plurality of movable play set components sufficiently limited in number and size to enable the plurality of components to be stored in storage positions within the play set interior in a closed configuration of the play set and to be removed from the storage position and from the play set in an open configuration of the play set, at least two of the plurality of movable components being removable from the respective storage positions of each and further being repositionable in the open configuration of the body into at least one play position supported by the body and different from the respective storage position of each of the at least two movable components; and a base platform at the first end of the body, a center of the base platform being at least generally aligned with the center axis, the base platform including an outer end surface at the first end sufficiently flat to support the body in the upright orientation on a substantially flat surface, wherein the body further includes a side wall support and a first platform rotatably engaged with the side wall support, the first platform having an outer surface forming part of the side wall in the closed configuration of the body, the first platform being rotatable from and toward an initial position, a center of the first platform being aligned with the center axis of the body in the initial position of the first platform, and wherein the base platform is non-rotatably fixed with an end of the side wall support spaced from the first platform;

the play set having in at least a closed configuration, at least one longitudinal end sized and shaped to fit at least partially into the beverage cup holder sufficiently for the beverage cup holder to support the play set in a generally upright orientation with another opposing end of the play set forming a top end of the play set.

17. The toy play set of claim 16, wherein the plurality of components further includes a ramp pivotably engaged with the base platform so as to be extendable outwardly from the base platform, generally perpendicular to the center axis, when the body is in the open configuration and the plurality of components is in the at least one play position, and to extend generally away from the base platform toward the second end, generally parallel to the center axis, when the body is in the closed configuration and the plurality of components is in the storage position.

18. The toy play set of claim 17, wherein the ramp forms a portion of the side wall when the body is in the closed configuration and the plurality of components is in the storage position.

19. A toy play set for use in a vehicle having a beverage cup holder, the toy play set comprising:

a generally elongated body having a hollow interior, a center axis, first and second opposing longitudinal ends and a generally curved side wall extending around the hollow interior and center axis between the ends whereby the ends and side wall generally surround the hollow interior in a closed configuration of the body, the body having at least one opening in the side wall and an open configuration in which the hollow interior is at least partially accessible through the at least one opening in the side wall, wherein a first portion of the body is pivotably attached to a second portion of the body to rotate with respect to the second portion along at least one eccentric axis generally parallel to the center axis, and wherein each of the first and second portions makes up substantially a half of the side wall of the body; and a plurality of movable play set components sufficiently limited in number and size to enable the plurality of components to be stored in storage positions within the play set interior in a closed configuration of the play set and to be removed from the storage position and from the play set in an open configuration of the play set, at least two of the plurality of movable components being removable from the respective storage positions of each and further being repositionable in the open configuration of the body into at least one play position supported by the body and different from the respective storage position of each of the at least two movable components;

the play set having in at least a closed configuration, at least one longitudinal end sized and shaped to fit at least partially into the beverage cup holder sufficiently for the beverage cup holder to support the play set in a generally upright orientation with another opposing end of the play set forming a top end of the play set.

20. A toy play set for use in a vehicle having a beverage cup holder, the toy play set comprising:

a generally elongated body having a hollow interior, a center axis, first and second opposing longitudinal ends and a generally curved side wall extending around the hollow interior and center axis between the ends whereby the ends and side wall generally surround the hollow interior in a closed configuration of the body, the body having at least one opening in the side wall and an open configuration in which the hollow interior is at least partially accessible through the at least one opening in the side wall, wherein a first portion of the body is pivotably attached to a second portion of the body to rotate with respect to the second portion along at least one eccentric axis generally parallel to the center axis;

a plurality of movable play set components sufficiently limited in number and size to enable the plurality of components to be stored in storage positions within the play set interior in a closed configuration of the play set and to be removed from the storage position and from the play set in an open configuration of the play set, at least two of the plurality of movable components being removable from the respective storage positions of each and further being repositionable in the open configuration of the body into at least one play position supported by the body and different from the respective storage position of each of the at least two movable components; and a generally cup-shaped lid that is removably attachable to at least one of the first and second ends of the body;

the play set having in at least a closed configuration, at least one longitudinal end sized and shaped to fit at least partially into the beverage cup holder sufficiently for the beverage cup holder to support the play set in a generally upright orientation with another opposing end of the play set forming a top end of the play set.

* * * * *